US007520003B2

(12) United States Patent
Meyers et al.

(10) Patent No.: US 7,520,003 B2
(45) Date of Patent: Apr. 21, 2009

(54) SAFETY BATH AND SHOWER MAT

(75) Inventors: Daniel Seth Meyers, Roxboro (CA); Cristian Boar, Montreal (CA); Wei Xiao, Montreal (CA)

(73) Assignee: AMG Medical Inc., Montreal, Quebec (CA)

( * ) Notice: Subject to any disclaimer, the term of this patent is extended or adjusted under 35 U.S.C. 154(b) by 546 days.

(21) Appl. No.: 11/082,946

(22) Filed: Mar. 18, 2005

(65) Prior Publication Data

US 2006/0207011 A1 Sep. 21, 2006

(51) Int. Cl.
*A47K 3/02* (2006.01)

(52) U.S. Cl. ..... 4/583

(58) Field of Classification Search ..... 4/580–583; D24/200, 212; 601/134
See application file for complete search history.

(56) References Cited

U.S. PATENT DOCUMENTS

D85,859 S * 12/1931 Capouch ..... D6/583
3,885,555 A * 5/1975 Nobbs ..... 601/28
4,329,981 A 5/1982 Dungl
5,158,073 A 10/1992 Bukowski
5,375,271 A 12/1994 Frankel
5,575,034 A 11/1996 Biernacinski et al.
5,781,941 A * 7/1998 Radke et al. ..... 4/583
D396,756 S 8/1998 Flauto et al.
5,829,070 A 11/1998 Taylor
D471,636 S * 3/2003 Yu ..... D24/212
6,530,096 B1 3/2003 Mayhew et al.
6,579,250 B2 6/2003 Robbins, III et al.
6,656,562 B2 12/2003 Malpass et al.
6,681,416 B1 * 1/2004 Yang ..... 4/583
D494,402 S 8/2004 Scansetti
2002/0142125 A1 * 10/2002 Seal ..... 428/81

* cited by examiner

*Primary Examiner*—Huyen Le
(74) *Attorney, Agent, or Firm*—Ogilvy Renault LLP

(57) ABSTRACT

A safety mat for use in bathtubs or shower stalls provides comfortable and safe conditions for users during a bath or shower. The safety mat can be optionally used with a seating aid placed directly on a floor of a bathtub or shower stall, and restrains substantial movement of the seating aid in order to prevent a user sitting on the seating aid from falling therefrom.

9 Claims, 5 Drawing Sheets

SAFETY BATH AND SHOWER MAT

FIELD OF THE INVENTION

The present invention relates to a safety mat used in a bathtub or shower stall, and more particularly to a safety mat having multi-functional features to provide satisfaction for users.

BACKGROUND OF THE INVENTION

It is well known that bathtubs and shower stalls are slippery and present a great risk of injury to users standing therein, and entering or leaving the bathtub or shower stall, especially in the presence of water and soap. This is because bathtubs and shower stalls are generally made of materials, such as acrylic, cast iron porcelain, steel and polymer, etc, which do not have a high coefficient of friction with human skin. In attempts to compensate for this problem, various safety mats or safety strips are available which provide an increased resistance to slipping while standing in the bathtub or shower stall, and thus minimize the risk of slippage of a person standing thereon.

It is also known in the art to use foot massage mats which include a multiplicity of conical protrusions having rounded apexes in order to massage a user's feet, thereby stimulating the feet and enhancing blood circulation of the user.

People using a bathtub or shower stall, particularly elderly and handicapped people, sometimes require seating aids to be placed in bathtubs or shower stalls, which help to prevent the inherent risks and difficulties involved in positioning themselves on the floor of a bathtub or shower stall by permitting the user to be seated at a relatively higher position than if they were seated on the floor of the bathtub or shower stall or on a safety mat placed therein. However, the floor of bathtubs and shower stalls, particularly in the presence of water and soap is also very slippery to a seating aid such as a bath or shower bench having its legs supported on the floor of a bathtub and shower stall, and thereby presents the risk of the user slipping and falling while sitting on such a seating aid during a bath or shower.

It is also undesirable to have the seating aids stand on the bath or shower mats directly, due the stability concern. When a seating aid stands directly on a bath or shower mat, pressing forces are unevenly applied to the mat, which compromises the stable attachment of the mat on a wet and soapy floor of a bathtub or shower stall, particularly in instances of mats having a limited number of suction cups on the bottom surface thereof.

Conventional bath or shower mats present other disadvantages. For example, the thin layer construction of conventional bath or shower mats does not allow frequent machine washing and thus mildew and bacteria may grow on these mats over time.

Therefore, there is a need for a safety apparatus overcoming the disadvantages of the conventional mat in order to provide comfortable and safe conditions for users during a bath or shower.

SUMMARY OF THE INVENTION

One object of the present invention is to provide a safety apparatus for use in bathtubs and shower stalls.

In accordance with one aspect of the present invention, there is a safety mat provided for use in bathtubs and shower stalls to prevent slippage of a user while standing thereon or while sitting on a seating aid positioned thereabove, which comprises a bottom surface and a top surface thereof. The bottom surface has a plurality of suction cups for releasably securing the mat on a supporting surface. The top surface has at least one pattern of elements raised therefrom for preventing slippage of the user standing thereon. There are also provided means for permitting side legs of said seating aid to be supported on the supporting surface while preventing same from substantial movement on the supporting surface.

In accordance with another aspect of the present invention, there is a safety mat provided for use in bathtubs and showers, which comprises a bottom surface and a top surface thereof. The bottom surface has a plurality of suction cups for releasably securing the mat on a supporting surface. The top surface defines a comfort zone, an acupressure zone and a soothing massage zone. The comfort zone has a plurality of elements in a flat and low profile raised from the top surface. The acupressure zone has a plurality of nipple-shaped elements raised from the top surface. The soothing massage zone has a plurality of longitudinal ridges in a high profile raised from the top surface.

In accordance with one embodiment of the present invention, a safety mat is provided for use in bathtubs and shower stalls to prevent slippage of a user standing thereon or sitting on a seating aid positioned thereabove, which comprises a bottom surface, a top surface and a periphery thereof. The periphery includes opposed sides defining therebetween a transverse dimension of the mat and opposed ends defining therebetween a longitudinal dimension of the mat, the longitudinal dimension being greater than the transverse dimension. The bottom surface has a plurality of suction cups for releasably securing the mat on a supporting surface. The top surface defines a comfort zone, an acupressure zone and a soothing massage zone. The comfort zone includes a major area of the top surface and has a plurality of elements in a flat and low profile raised from the top surface. The acupressure zone includes areas adjacent to the opposed ends of the mat and has a plurality of nipple-shaped elements raised from the top surface. The soothing massage zone includes areas adjacent to opposed sides of the mat and has a plurality of longitudinal ridges in a high profile raised from the top surface. Said periphery further defines two lateral recesses at each of the opposed side of the mat, permitting respective four legs of said seating aid to be supported on the supporting surface of the bathtub or shower stall while preventing same from substantial movement on the supporting surface.

The safety mat in accordance with another embodiment of the present invention preferably further comprises a flexible thermal-indicia on the top surface thereof.

The present invention advantageously provides a safety apparatus for use in bathtubs and shower stalls to prevent slippage of a user either standing thereon or sitting on a seating aid placed in bathtubs or shower stalls, optionally providing additional massage functions and hot water temperature warning. Other features and advantages of the present invention will be better understood with reference to the preferred embodiments described hereinafter.

DETAILED DESCRIPTION OF THE PREFERRED EMBODIMENT

Figure 1:
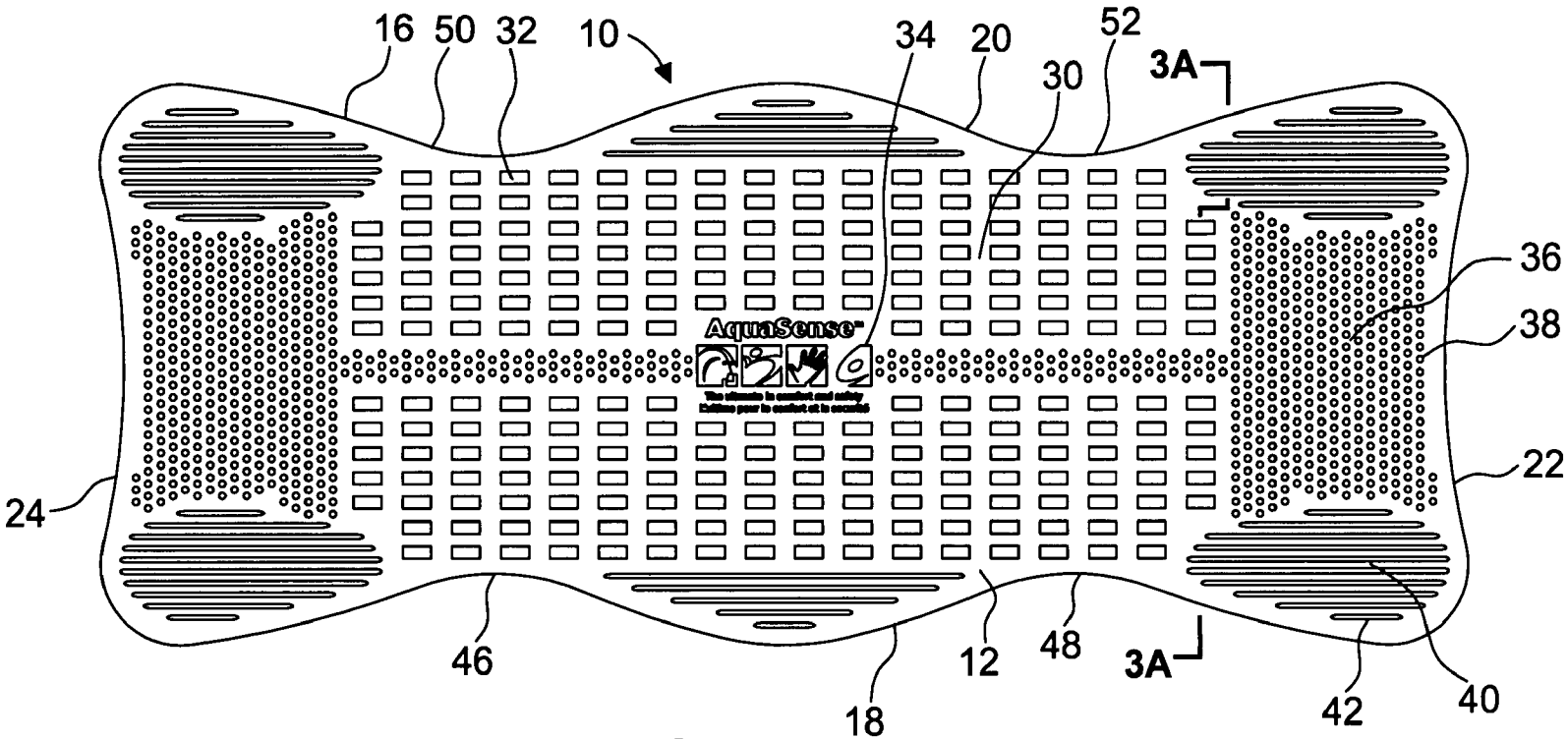
FIG. 1 is a top plane view of a safety mat in accordance with one embodiment of the present invention, showing a top surface thereof.
Figure 2:
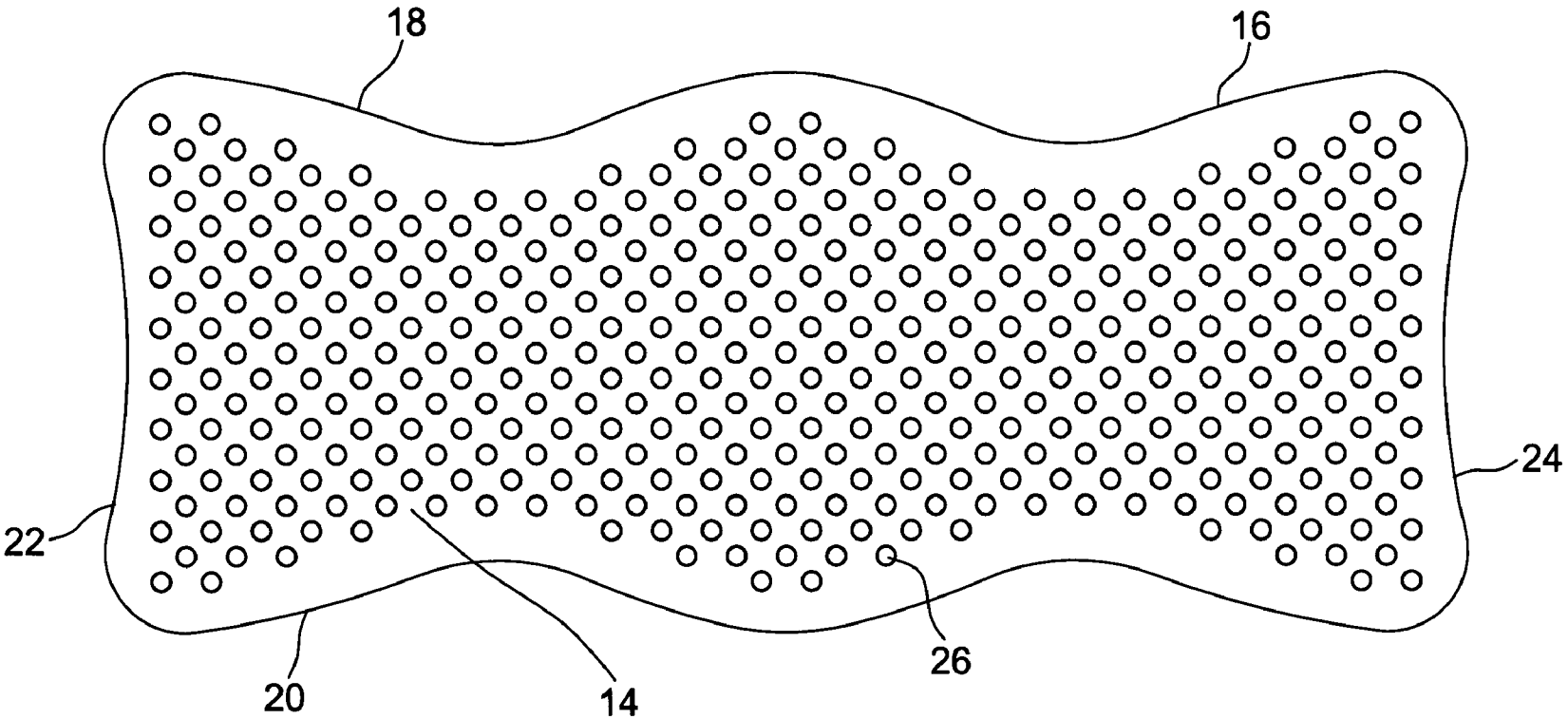
FIG. 2 is a bottom plane view of the safety mat of FIG. 1 showing a bottom surface thereof.

Referring to FIGS. 1, 2, 3A-3B and 5, a safety mat referred to as a "bath mat" 10 hereinafter for convenience of description, is provided for use in bathtubs 60 or shower stalls (not shown). The bath mat 10 can be of multiple layers but according to this embodiment is a single layer configuration, and is made of any known material suitable for this type of product, such as rubber, plastics, etc. The thickness of the bath mat 10 is variable. In accordance with this preferred embodiment of the present invention, a sturdy construction with body thickness at 2.5 mm is provided to allow for convenient machine washing and longer lifespan. Such a sturdy construction is also beneficial to secure attachment of the bath mat 10 to the floor of the bathtub or shower stall, preventing the bath mat 10 from floating and getting loose. Furthermore, the bath mat 10 preferably includes an antimicrobial formulation that helps control the growth of mildew and bacteria on the mat.

The bath mat 10 includes a body having a top surface 12, a bottom surface 14 and a periphery 16 therearound. The periphery 16 includes opposed sides 18, 20 defining therebetween a transverse dimension of the bath mat 10, and opposed ends 22, 24 defining therebetween a longitudinal dimension of the bath mat 10. The longitudinal dimension is preferably greater than the transverse dimension.

The bottom surface 14 includes a plurality of suction cups 26. Each suction cup 26 has a circular contacting edge 28 (see FIG. 3A) which makes contact with the supporting surface on which the bath mat 10 rests. Upon an initial force being applied on the bath mat 10, such as a foot step, the suction cup 26 is deformed and air is forced out of the suction cup, which creates a low pressure area or near vacuum inside the suction cup 26, thereby providing a force acting to adhere the bath mat 10 to the supporting surface and assisting in retaining the bath mat 10 in its original position.

The particular size and shape of the suction cups 26 can vary and they can be positioned in a variety of arrangements. In this embodiment, over four hundred suction cups 26 are substantially evenly distributed over the entire area of the bottom surface 14 of the bath mat 10, and are provided to ensure an active, secure grip that conforms to the bathtub 60, making it safer for users.

The top surface 12 includes at least one pattern of elements raised therefrom for preventing slippage of the user standing thereon, which will be further described in detail below.

The top surface 12 preferably defines a comfort zone 30 including a major area of the top surface 12, for example, as shown in FIG. 1, and having a plurality of elements in a flat and low profile raised from the top surface 12, for example rectangular protrusions 32 having a flat top thereof (see FIG. 3A) according to this embodiment. The flat, rectangular protrusions 32 have a low profile, for example, approximately 1 mm in this embodiment, which provide a secure grip and comfortable feel to a user's feet when standing thereon because the user's feet contact not only the flat top of the low profile protrusions 32, but also a portion of the top surface 12 between the flat, low profile protrusions 32. Thus, the entire soles of the user's feet substantially evenly bear the user's weight.

The comfort zone 30 preferably takes up a majority of the longitudinal length in a mid-portion of the bath mat 10. Thus, whenever a user enters or leaves the bathtub 60 having the bath mat 10 resting on the floor thereof, or moves from a sitting position thereon to stand up, or slightly moves his/her body position in the bathtub 60 during a shower, it is convenient for the user to locate his/her feet within the comfort zone 30 of the bath mat 10.

Optionally, the comfort zone 30 further includes a number of product indicia elements 34 which have flat tops and low profiles similar to the flat, low profile protrusions 32, such that the product indicia elements 34 together with adjacent flat, low profile protrusions 32, provide a secure grip and comfortable feeling to the user's feet. The product indicia elements 34 can, for example, represent a trademark, logo, text, or other message.

The top surface 12 includes an acupressure zone 36 preferably including areas adjacent to the opposed ends 22, 24. These two areas of the acupressure zone 36 are generally spaced apart by the comfort zone 30 therebetween. The acupressure zone 36 includes a plurality of nipple-shaped elements 38 which preferably have a conical body with a rounded top, raised from the top surface 12 (see FIG. 3A). The concept of acupressure, which is also referred to as "reflexology massage" and utilizes the thumb, knuckles or some other external mechanical or electrical massaging implement to apply pressure to the selected meridian points. In the methodology of acupressure, as in acupuncture, it is thought that various organs, nerves and glands in the body are connected with certain "reflex areas" located on the bottom of the feet, the hands and other meridian related areas of the body. By massaging these reflex areas and through the resulting stimulating response, therapeutic help for various body ailments and pain reduction is considered to be achieved.

Therefore, the nipple-shaped elements 38 are preferably sized and distributed in a manner so as to provide effective stimulation to the user's feet which helps to work away knots and relieve tension. The nipple-shaped elements 38 preferably have a height greater than the flat, low profiled protrusions 32, but are determined by the properties of the material of the bath mat 10 in order to maintain a relative hardness thereof for the effective stimulation to the user's feet standing thereon.

Location of the acupressure zone 36 at the opposed longitudinal ends of the bath mat 10 allow the user to control access to the acupressure zone 36 by stepping back and forth from the comfort zone 30 of the bath mat 10 to the nipple-shaped elements 38, for foot acupressure massage when desired. In this embodiment, a narrow strip (not indicated) of the acupressure zone extends inwardly from each of the end areas thereof to meet a central region of the top surface 12 having the product indicia elements 34 of the comfort zone 30. Thus the narrow strips of the acupressure zone 38 substantially divide the comfort zone 30 into two major longitudinal areas except for the central region having the product indicia elements 34. Such a design of the comfort zone 30 and acupressure zone 36 provides more flexibility and convenience for a user to select acupressure massaging in the bathtub 60 and does not compromise the convenience for the user to use the comfort zone 30.

Figure 3A:
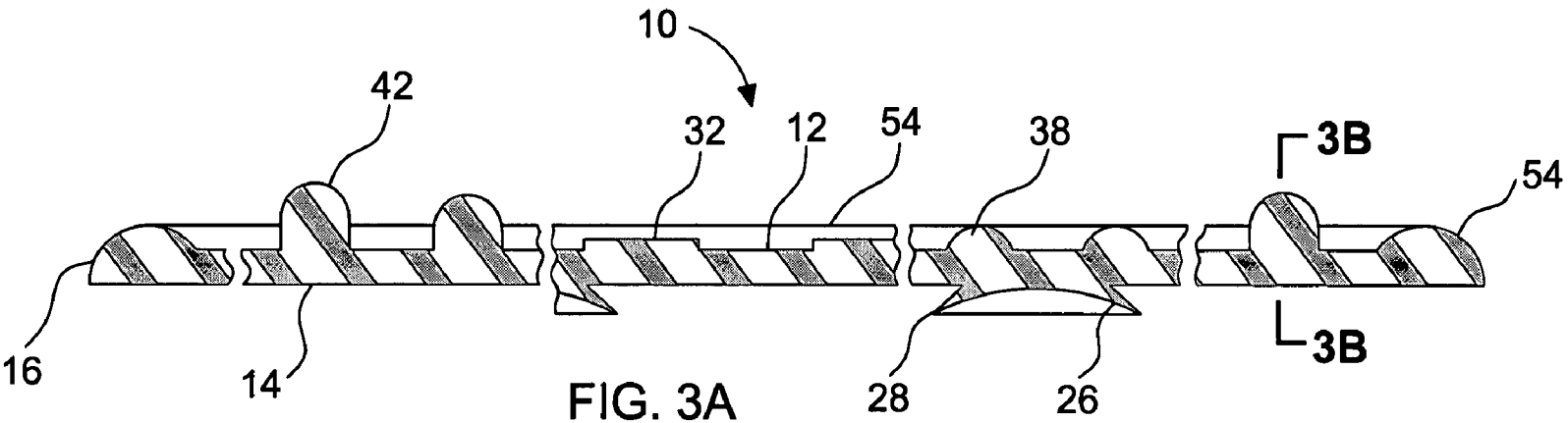
FIG. 3A is a partial cross-sectional view of the safety mat of FIG. 1 taken along line 3A-3A, showing the profiles of the various zones on the top surface and suction cups on the bottom surface thereof.
Figure 3B:
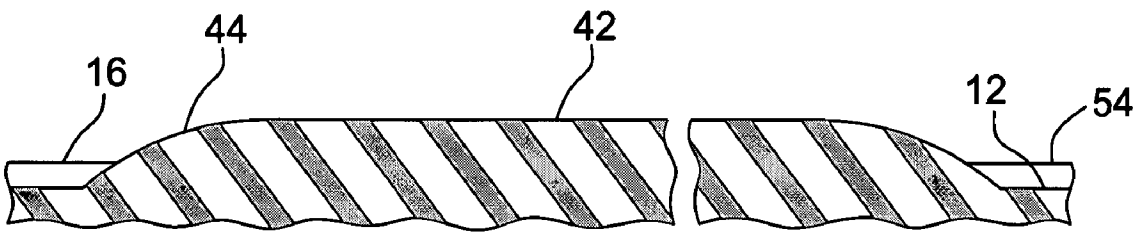
FIG. 3B is a partial cross-sectional view of the safety mat of FIG. 3A taken along line 3B-3B, showing a high profile, longitudinal ridge in a soothing zone of the top surface of the mat.

The top surface 12 of the bath mat 10 preferably further includes a soothing massage zone 40 including areas adjacent to opposed sides 18, 20 of the bath mat 10, and having a plurality of longitudinal ridges 42 in a high profile raised from the top surface 12 (see FIG. 3B). The longitudinal ridges 42 are positioned parallel one with another and spaced in a manner such that a certain number of the longitudinal ridges 42 contacts the sole of a user's foot in order to provide a massaging effect thereto when the foot is placed in an area of the soothing massage zone 40.

Each longitudinal ridge 42 preferably has a width equal to or somewhat narrower than the diametrical dimension of the bottom of the nipple-shaped element 38 and a height greater than the nipple-shaped element 38, for example, about 4-4.5 mm. Such dimensions and profile make the longitudinal ridges 42 possess a property thereof softer than the nipple-shaped elements 38 in order to provide less stimulation than the nipple-shaped elements 38, but are still hard enough to provide a relatively comfortable soothing massage to the user's feet. Optionally, each longitudinal ridge 42 preferably has a rounded top (see FIG. 3A) and a smooth transition 44 in height at ends thereof (see FIG. 3B) in order to further ensure the comfortable feel to the user's feet. It is also optional to have the longitudinal ridges 42 slightly different in height. For example, the ridges in the middle are higher than those at the sides in each area.

Because of the curved shape of the periphery 16 of the bath mat 10 which will be further described below, the soothing massage zone 40 is divided, for example, into four end areas, each being located at one corner of the top surface 12 of the bath mat 10. Optionally, two side areas of the soothing massage zone 40 can be additionally located at the middle of the longitudinal length of the bath mat 10 outside of the comfort zone 30, when the sides 18, 20 of the bath mat 10 are configured as in FIG. 1. With such a design of area distribution of the soothing massage zone 40, the user standing on the comfort zone 30 can conveniently access a pair of areas of the soothing massage zone 40 at a forward end, middle position or backward end of the bath mat 10, for a selective relaxing, therapeutic effect which will help to improve circulation during a shower in a bathtub 60.

In accordance with this embodiment, the bath mat 10 preferably further defines two lateral recesses 46, 48 at one side 18 and two lateral recesses 50, 52 at the other side 20, preferably symmetrical about a longitudinal axis (not shown) of the bath mat 10, which together define a means for permitting side legs of a seating aid 62 (see FIG. 5) to be supported on the floor of the bathtub 60 while preventing same from substantial movement on the floor of the bathtub 60.

The periphery 16 of the bath mat 10 optionally includes a ridge 54 raised from the top surface 12 thereof (see FIGS. 3A and 3B), at least along each of the opposed sides 18, 20, but preferably being continuous around the edges of the bath mat 10. The peripheral ridge 54 helps maintain a flat condition when the bath mat 10 rests on the floor of the bathtub 60, and further helps restrain movement of the seating aid 62 supported on the floor of the bathtub 60.

The shape of the lateral recesses of the bath mat 10 can vary, such as being narrower than the lateral recesses 46-52 as shown in the drawings. Nevertheless, the wide open lateral recesses 46-52 with smooth curved peripheries thereof provide a more pleasing visual presentation. The wide open lateral recesses 46-52 with smooth curved peripheries may not be enabled to completely restrict a slight motion of the legs of the seating aid 62 about a standing position, but do prevent substantial movement of same away from the standing position, thereby preventing the user of the seating aid 62 from falling.

Alternatively, the lateral recesses 46, 48, and 50, 52 respectively, can be replaced by a single recess (not shown) at each side 18, 20 of the bath mat 10. The single lateral recess, for example has a flat bottom and defines a lateral opening for suitably accommodating two of the legs of the seating aid 62 at each side of the bath mat 10. In a further alternative configuration, the bath mat can have a pair of straight sides without lateral recesses but has four openings (not shown) located adjacent to the opposed straight sides to allow the individual legs of the seating aid to extend therethrough to be supported on the floor of the bathtub 60. All the alternative configurations which are preferably symmetrical about the longitudinal axis of the bath mat, define means for permitting side legs of the seating aid to be supported on the floor of the bathtub 60 while preventing same from substantial movement on the floor of the bathtub 60.

Figure 5:
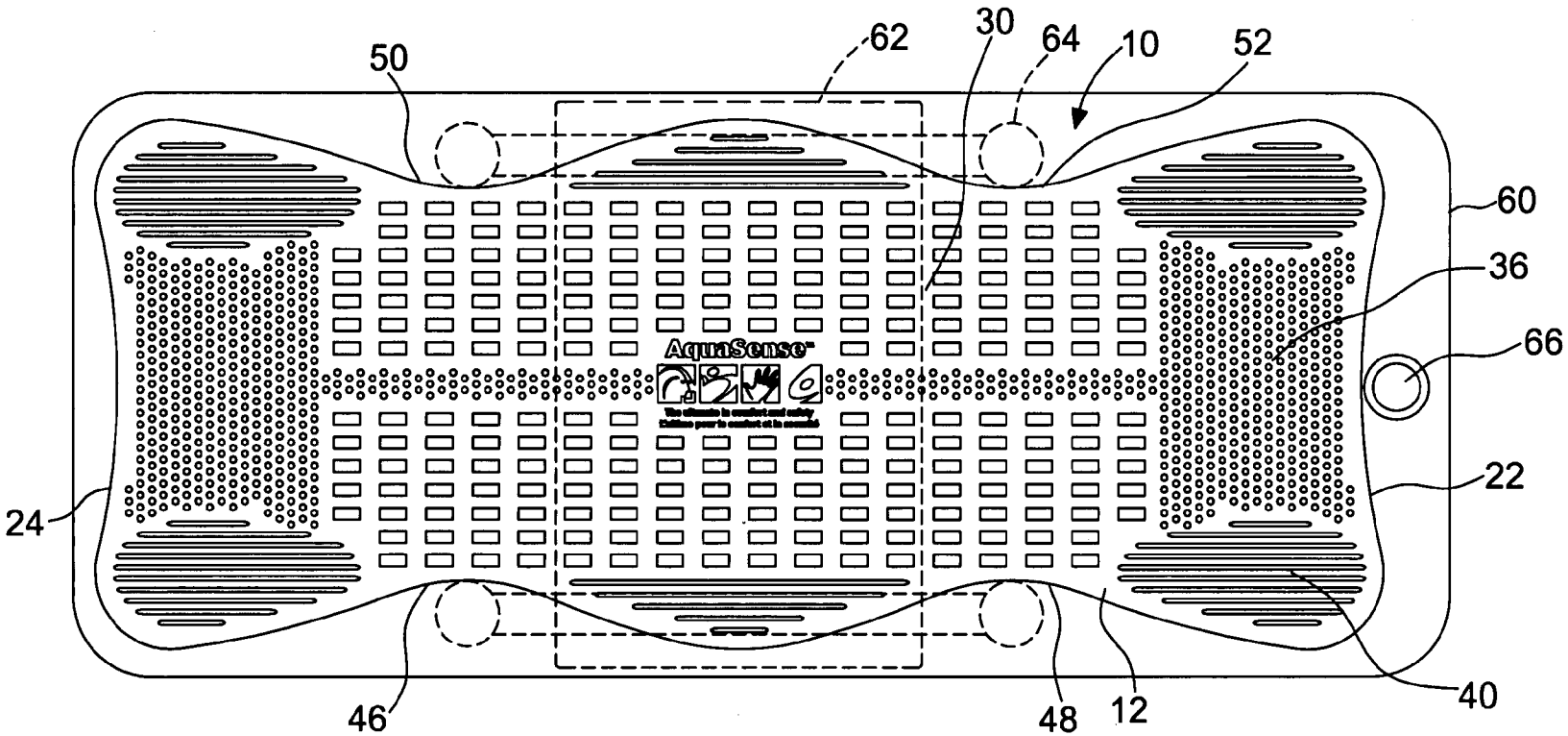
FIG. 5 is a top plane view of the safety mat of FIG. 1 placed together with a bath bench in a bathtub.

Referring to FIG. 5, the bath mat 10 has at least one of the ends 22, 24 but preferably both ends 22, 24 according to this embodiment, centrally and longitudinally recessed in order to better cover the floor of the bathtub 60 without blocking the drain 66.

Figure 4:
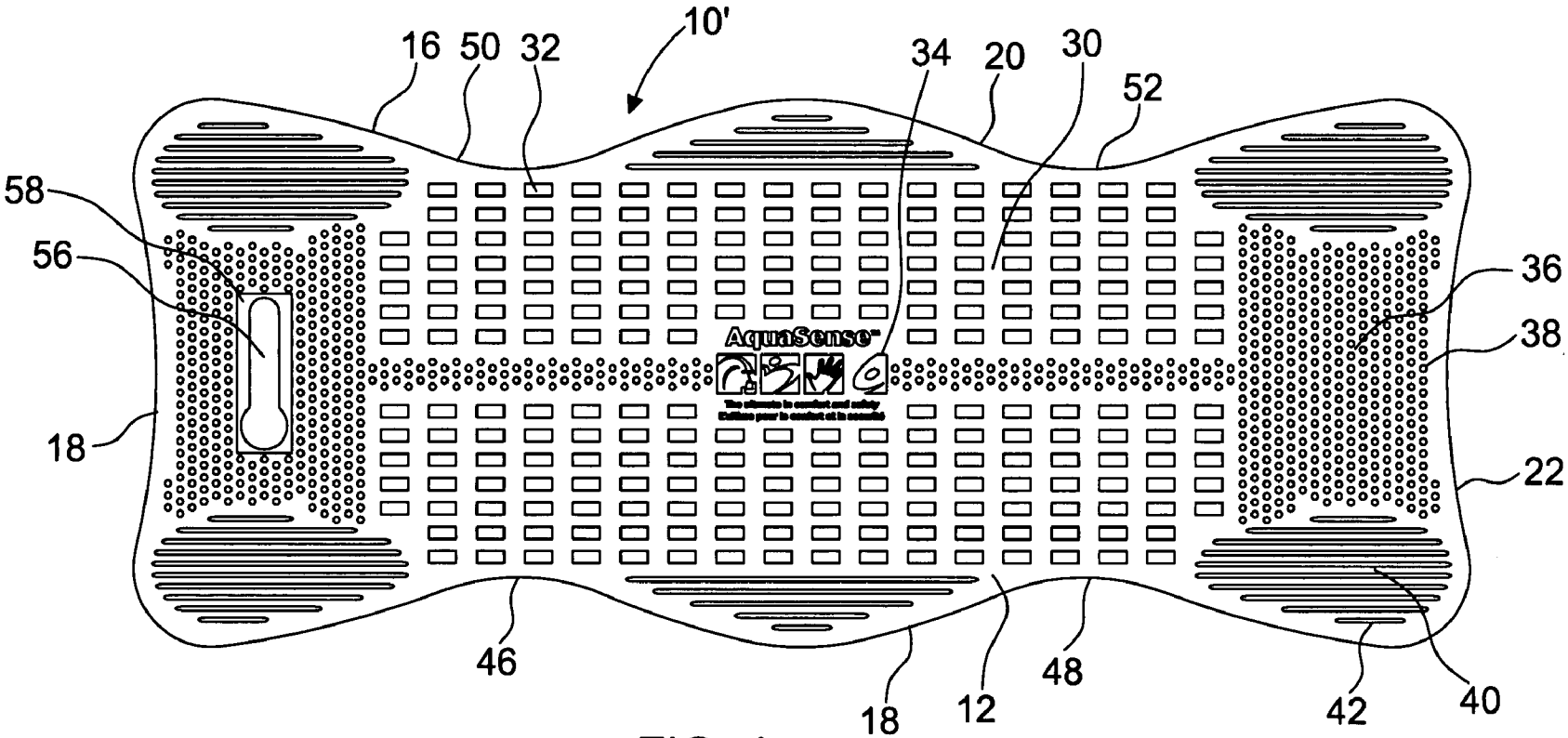
FIG. 4 is a top plane view of a safety mat in accordance with another embodiment of the present invention, showing the top surface thereof having a flexible temperature indicator thereon.

Referring to FIG. 4, there is a safety mat for use in a bathtub or a shower stall referred to as bath mat 10' for the purpose of convenience of description. The bath mat 10' is similar to the bath mat 10 of FIGS. 1, 2, 3A, 3B and 5, and similar components and features are indicated by similar numerals, and will not therefore be redundantly described herein. Bath mat 10' in contrast to bath mat 10 of FIG. 1, has an additional feature with the purpose of warning of approximate water temperature in a "too hot range" in order to allow the user to avoid the risk of scalding. This additional feature is achieved by means of a flexible temperature indicator 56 which is placed within a slot 58 in the bath mat 10' on the top surface 12 thereof. The flexible temperature indicator 56 is printed in liquid crystal technology preferably for a thermo-indicia of cool, warm and hot ranges. A thermochromic ink is preferably selected to indicate a dangerous temperature range which reaches above 50° C. (122° F.). The flexible temperature indicator 56 can be located not only in one end area of the acupressure zone 36 as shown in FIG. 4, but also in any location of the top surface 12 of the bath mat 10'.

Modifications and improvements to the above-described embodiments of the present invention may become apparent to those skilled in the art. The foregoing description is intended to be exemplary rather than limiting. For example, the particular locations of the comfort zone, acupressure zone, and soothing massage zone as well as the product indicia elements can vary in various layout configurations. The scope of the present invention is therefore intended to be limited solely by the scope of the appended claims.

We claim:

1. A safety mat for use in bathtubs and shower stalls comprising:

a bottom surface having a plurality of suction cups for releaseably securing the mat on a supporting surface; and a top surface defining a plurality of zones in an arrangement for providing an access only to selected zones to a user, which includes:

a comfort zone having a plurality of elements in a flat and low profile raised from the top surface, an acupressure zone substantially defined at opposed ends of the top surface, having a plurality of nipple-shaped elements raised from the top surface, and a soothing massage zone substantially defined in areas at opposed sides of the top surface, having a plurality of longitudinal ridges in a high profile raised from the top surface.

2. The safety mat as claimed in claim 1 wherein the opposed sides define therebetween a transverse dimension of the mat and the opposed ends define therebetween a longitudinal dimension of the mat, the longitudinal dimension being greater than the transverse dimension.

3. The safety mat as claimed in claim 2 wherein the opposed sides comprise lateral recesses thereof to define means for permitting side legs of a seating aid to be supported on the supporting surface while preventing same from substantial movement on the supporting surface.

4. The safety mat as claimed in claim 2 wherein each of the opposed ends comprises a longitudinal and central recess.

5. The safety mat as claimed in claim 2 wherein said comfort zone comprises a major area of the top surface.

6. The safety mat as claimed in claim 1 wherein the top surface thereof comprises a ridge extending along a periphery of the mat.

7. A safety mat for use in bathtubs and shower stalls to prevent slippage of a user standing thereon or sitting on a seating aid positioned thereabove, comprising:

a periphery including opposed sides defining therebetween a transverse dimension of the mat, and opposed ends defining therebetween a longitudinal dimension of the mat, the longitudinal dimension being greater than the transverse dimension, the transverse dimension varying to define two lateral recesses at each of the opposed sides and a substantially equal width of the mat at the respective opposed ends and at a middle portion of the mat;

a bottom surface having a plurality of suction cups for releaseably securing the mat on a supporting surface; and a top surface defining a plurality of zones in an arrangement for providing a selected access thereof, which includes:

a comfort zone including a major area of the top surface and having a plurality of elements in a flat and low profile raised from the top surface, an acupressure zone including areas adjacent to the opposed ends of the mat and having a plurality of nipple-shaped elements raised from the top surface, and a soothing massage zone including areas adjacent to opposed sides of the mat and having a plurality of longitudinal ridges in a high profile raised from the top surface.

8. The safety mat as claimed in claim 7 wherein said periphery comprises a continuous ridge raised from the top surface.

9. The safety mat as claimed in claim 7 wherein the top surface thereof comprises a flexible thermo-indicia.

* * * * *